US006145953A

United States Patent [19]

Medin

[11] Patent Number: 6,145,953

[45] Date of Patent: Nov. 14, 2000

[54] INK SOLVENT APPLICATION SYSTEM FOR INKJET PRINTHEADS

[75] Inventor: Todd R Medin, Vancouver, Wash.

[73] Assignee: Hewlett-Packard Company, Palo Alto, Calif.

[21] Appl. No.: 09/007,437

[22] Filed: Jan. 15, 1998

[51] Int. Cl.[7] ..... B41J 2/165

[52] U.S. Cl. ..... 347/28; 347/33

[58] Field of Search ..... 347/28, 33

[56] References Cited

U.S. PATENT DOCUMENTS

| | | | |
|---|---|---|---|
| 4,024,548 | 5/1977 | Alonso et al. | 346/140 R |
| 4,306,245 | 12/1981 | Kasugayama et al. | 346/140 |
| 4,947,187 | 8/1990 | Iwagami | 347/28 |
| 5,051,758 | 9/1991 | Markham . | |
| 5,051,761 | 9/1991 | Fisher et al. | 347/30 |
| 5,300,958 | 4/1994 | Burke et al. | 346/140 |
| 5,557,306 | 9/1996 | Fukushima et al. | 347/33 |
| 5,614,930 | 3/1997 | Osborne et al. | 347/33 |
| 5,905,514 | 5/1999 | Rhoads et al. | 347/33 |
| 5,907,335 | 5/1999 | Johnson et al. | 347/28 |
| 5,914,734 | 6/1999 | Rotering et al. | 347/28 |

FOREIGN PATENT DOCUMENTS

| | | | |
|---|---|---|---|
| 0709204A1 | 5/1996 | European Pat. Off. | B41J 2/165 |
| 0786349A1 | 7/1997 | European Pat. Off. | B41J 2/165 |
| 02072961 | 3/1990 | Japan | B41J 2/165 |

OTHER PUBLICATIONS

Copy of European Search Report from related European Application No. 98 11 4551 dated Feb. 11,1999.

*Primary Examiner*—N. Le
*Assistant Examiner*—Shih-wen Hsieh
*Attorney, Agent, or Firm*—Flory L. Martin

[57] ABSTRACT

An ink solvent application system applies an inkjet ink solvent with a wiper to clean ink residue from an inkjet printhead. The solvent is stored in a porous applicator and extracted using capillary forces generated when the wiper is rubbed across the applicator. To retain sufficient amounts of ink solvent on the wiper, the wiper moves away from the applicator in a coordinated motion having both rotational and translational components. This coordinated motion for picking solvent from the applicator is superior to a purely rotational stroke of the wiper, which picks very little solvent. The wiper then wipes the solvent across the printhead to dissolve accumulated ink residue. The wiper then moves across a blotter to remove dissolved ink residue and dirty solvent from the wiper. A method of cleaning ink residue from an inkjet printhead, along with an inkjet printing mechanism having such a solvent application system, are also provided.

17 Claims, 6 Drawing Sheets

INK SOLVENT APPLICATION SYSTEM FOR INKJET PRINTHEADS

FIELD OF THE INVENTION

The present invention relates generally to inkjet printing mechanisms, and more particularly to an ink solvent application system that applies an inkjet ink solvent using a wiper system to clean inkjet printheads.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Since these permanent or semi-permanent printheads carry only a small ink supply, they may be physically more narrow than their predecessors, the replaceable cartridges. Narrower printheads lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

There are a variety of advantages associated with these off-axis printing systems, but the permanent or semi-permanent nature of the printheads requires special considerations for servicing, particularly when wiping ink residue from the printheads. Any abrasive wiping contact with the printheads could induce premature printhead failure, or degrade the print quality of the printed images. Thus, it would be desirable to have a printhead wiping system which cleans the printheads without any appreciable wear to promote an extended printhead lifespan.

SUMMARY OF THE INVENTION

According to one aspect of the present invention, a wiping system for cleaning an inkjet printhead in an inkjet printing mechanism. The wiping system includes a wiper, and a platform that supports the wiper for rotational movement and for translational movement between an application position and a wiping position for cleaning ink residue from the printhead. The wiping system has an ink solvent applicator impregnated with an ink solvent, with the applicator being located for contact with the wiper when the wiper is moved to the application position. The platform moves the wiper away from the applicator with a combination of both rotational movement and translational movement to retain the ink solvent on the wiper.

According to a further aspect of the present invention, an inkjet printing mechanism may be provided with a wiping system as described above.

According to another aspect of the present invention, a method of cleaning ink residue from an inkjet printhead in an inkjet printing mechanism is provided. This method includes a step of applying an ink solvent to a wiper by: (a) contacting the wiper with an applicator of a porous material impregnated with the ink solvent, (b) extracting the ink solvent from the applicator as a meniscus of solvent clinging to both the wiper and the applicator, and (c) lifting the wiper away from the applicator after allowing the meniscus to substantially reach equilibrium to retain the ink solvent on the wiper. In a wiping step, the ink residue is wiped from the printhead and a portion of the ink residue is dissolved in the ink solvent which was retained on the wiper.

According to a further aspect of the present invention, another method of cleaning ink residue from an inkjet printhead in an inkjet printing mechanism. This method includes a step of applying an ink solvent to a wiper by: (a) contacting the wiper with an applicator of a porous material impregnated with the ink solvent, (b) extracting the ink solvent from the applicator through capillary forces and into a capillary region defined between the applicator and the wiper, and (c) moving the wiper away from the applicator with both rotational movement and translational movement to retain the ink solvent on the wiper. In a wiping step, the ink residue is wiped from the printhead and a portion of the ink residue is dissolved in the ink solvent which was retained on the wiper.

According to still a further aspect of the present invention, an additional method of cleaning ink residue from an inkjet printhead in an inkjet printing mechanism is provided. This method includes the step of applying an ink solvent to a wiper by: (a) dragging the wiper in a first direction across an applicator of a porous material impregnated with the ink solvent to extract the ink solvent from the applicator trough capillary forces to form a meniscus of solvent between the wiper and the applicator, (b) pausing motion of the wiper after said dragging step to allow the meniscus to substantially reach equilibrium, and (c) removing the wiper from the applicator to retain the ink solvent on the wiper by simultaneously moving the wiper away from the applicator while also moving the wiper in a direction opposite said first direction. In a wiping step, the ink residue is wiped from the printhead and a portion of the ink residue is dissolved in the ink solvent which was retained on the wiper.

An overall goal of the present invention is to provide an inkjet printing mechanism which prints sharp vivid images over the life of the printhead and the printing mechanism, particularly when using fast drying pigment or dye-based inks, and preferably when dispensed from an off-axis system.

Another goal of the present invention is to provide an ink solvent application system for cleaning printheads in an inkjet printing mechanism to provide consumers with a reliable, economical inkjet printing unit.

BRIEF DESCRIPTION OF THE DRAWINGS

FIGS. 4–8 are enlarged, side elevational views of a wiper picking the ink solvent from an applicator in the application system of FIG. 1, with:

FIG. 4 showing an unsatisfactory manner of picking the solvent;

FIG. 5 showing a first phase of a preferred manner of picking the solvent;

FIG. 6 showing a second phase of the preferred manner of picking the solvent;

FIG. 7 showing a third phase of the preferred manner of picking the solvent;

FIG. 8 showing a fourth phase of the preferred manner of picking the solvent.

DETAILED DESCRIPTION OF A PREFERRED EMBODIMENT

Figure 1:
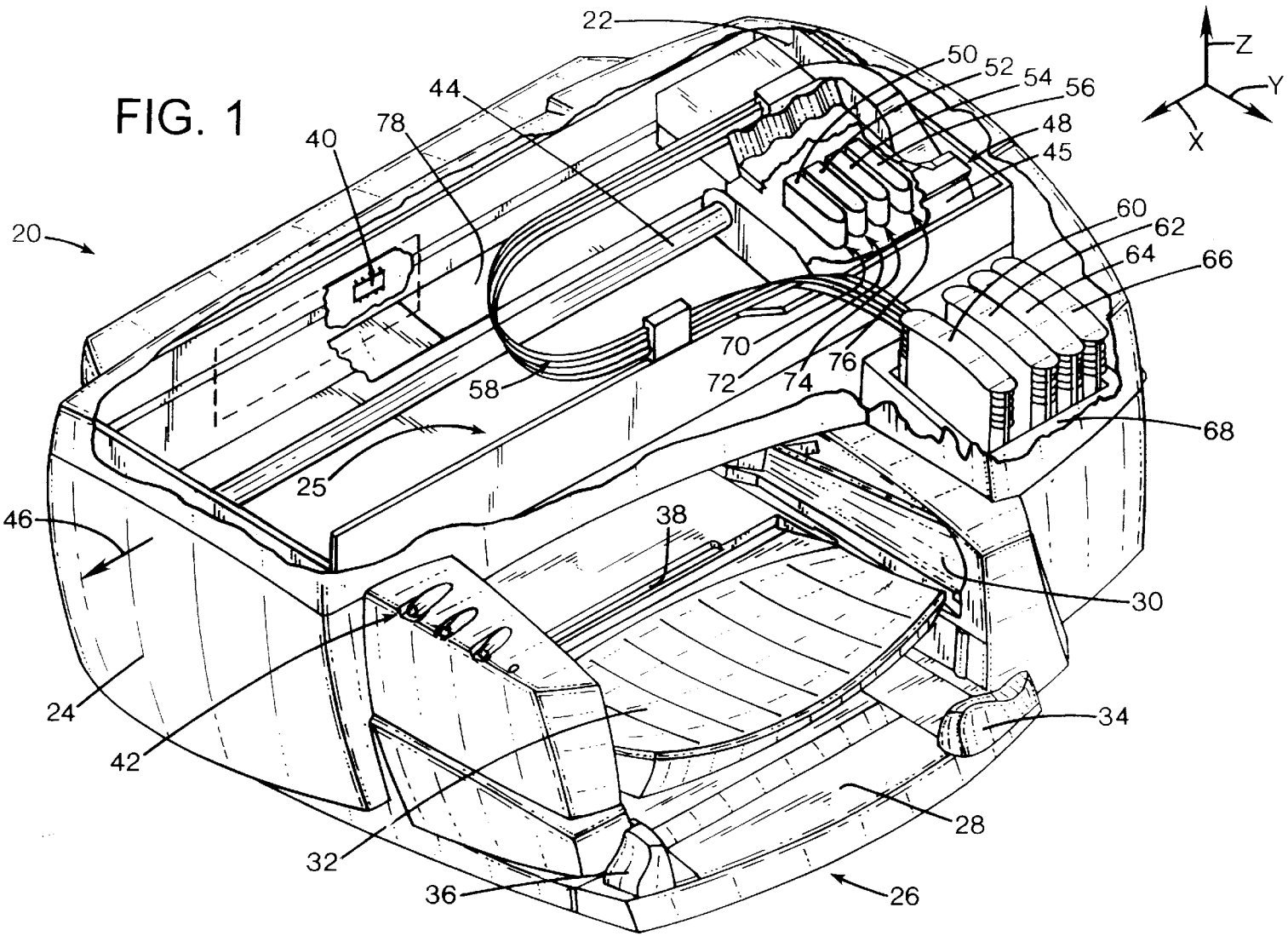
FIG. 1 is a perspective view of one form of an inkjet printing mechanism, here, an inkjet printer, including a printhead service station having one form of an ink solvent application system of the present invention for cleaning an inkjet printhead.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
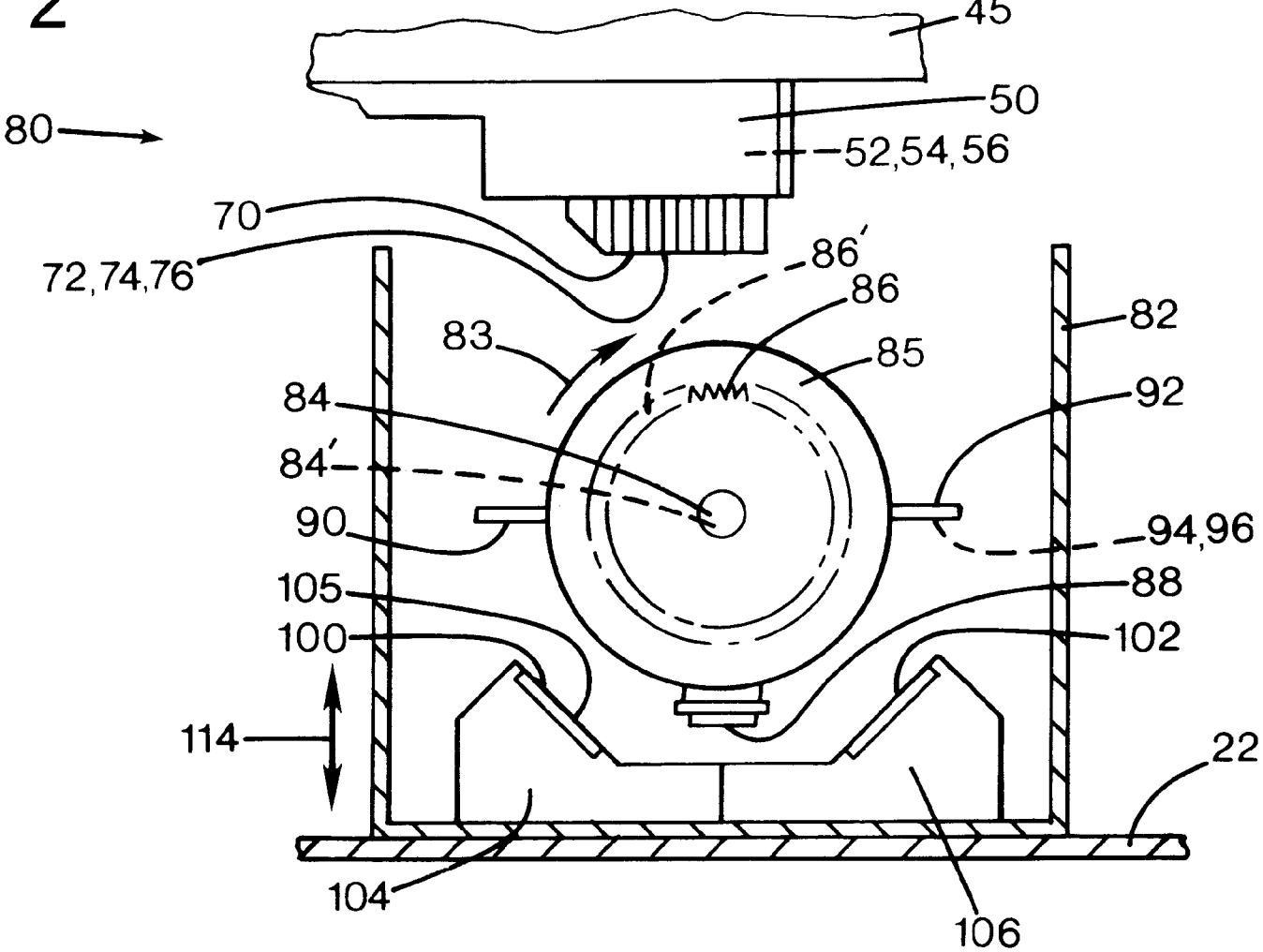
FIG. 2 is a side elevational view of the ink solvent application system of FIG. 1, along with an inkjet printhead.

In the printzone 25, the media sheet 34 receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Figure 3:
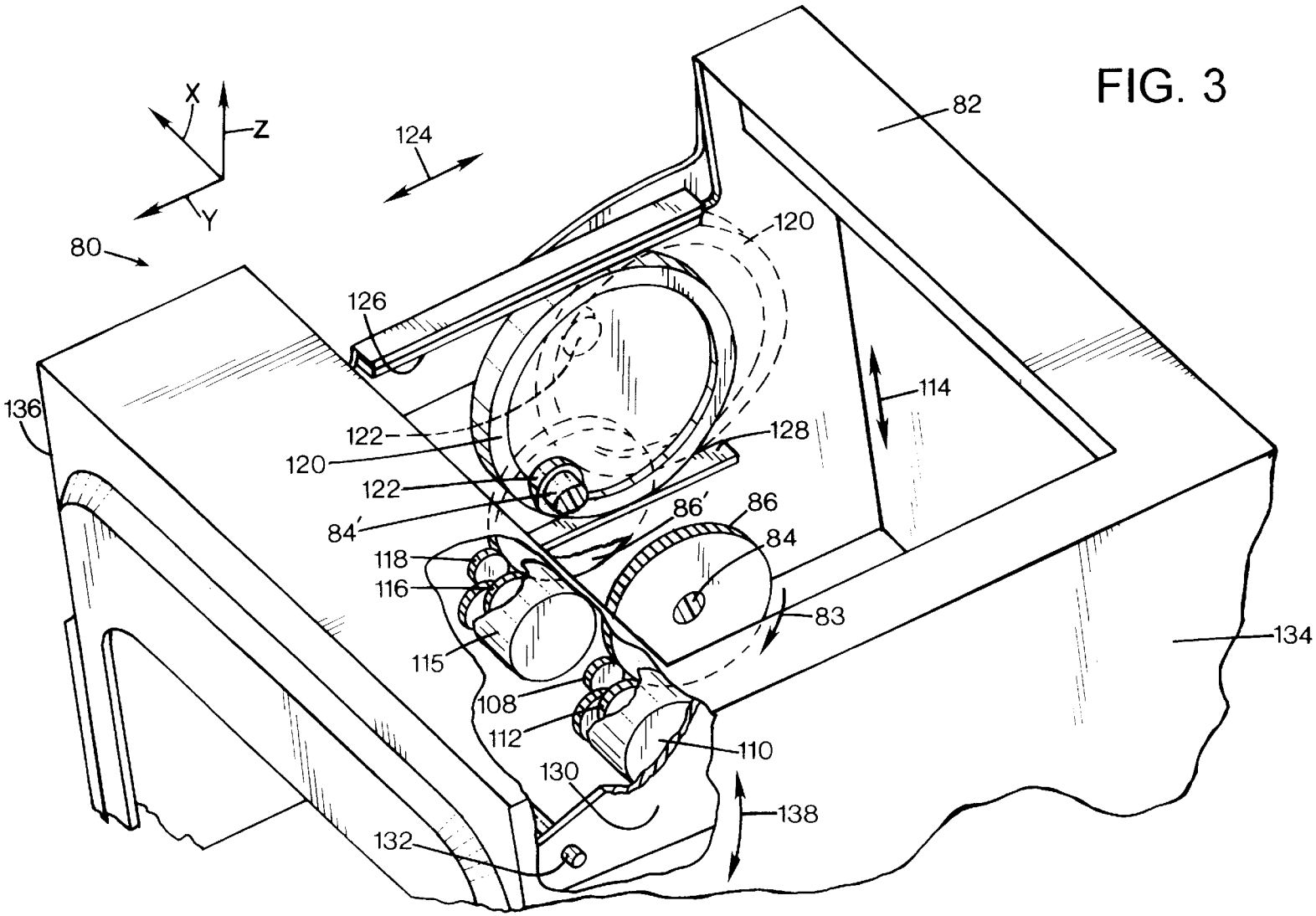
FIG. 3 is an enlarged, partially fragmented, perspective view of the service station of FIG. 1, with a tumbler portion omitted from the view for clarity.

FIGS. 2 and 3 illustrate one form of an ink solvent applying service station 80, constructed in accordance with the present invention. The service station 80 includes a frame 82 which is supported by the printer chassis 22 in the servicing region 48 within the printer casing 24. To service the printheads 70–76 of the pens 50–56, the service station 80 includes a moveable platform supported by the service station frame 82. Here, the servicing platform is shown as a rotary member having an axle supported by bearings or bushings housed within the service station frame 82 for rotation, as illustrated by arrow 83. The axle has an outboard end 84 and an inboard end 84', with the axle in the illustrated embodiment being parallel to the printhead scanning axis 46. As used herein, "inboard" refers to the side of the service station 80 which is closest to the printzone 25, while "outboard" refers to the side of the service station most distant from the printzone 25. The illustrated rotary member comprises a tumbler body 85 having an outboard drive gear 86 and an inboard drive gear 86'. The tumbler 85 carries a series of servicing components, such as a capping assembly 88, into position for servicing the printheads 70–76. The capping assembly 88 preferably includes four discrete caps for sealing each of the printheads 70–76, although only a single capping unit is visible in the view of FIG. 2.

Other servicing components carried by the rotary platform 85 include a black printhead wiper 90 for servicing the black printhead 70, and three color wipers 92, 94 and 96 for servicing the respective color printheads 72, 74 and 76, although in the side view of FIG. 2, the yellow wiper 96 obscures the view of the cyan and magenta wipers 92, 94. Preferably, each of the wipers, 90–96 is constructed of a flexible, resilient, non-abrasive, elastomeric material, such as nitrile rubber, or more preferably, ethylene polypropylene diene monomer (EPDM), or other comparable materials known in the art. For wipers 90–96, a suitable durometer, that is, the relative hardness of the elastomer, may be selected from the range of 35–80 on the Shore A scale, or more preferably within the range of 60–80, or even more preferably at a durometer of 70+/−5, which is a standard manufacturing tolerance.

By placing the black wiper 90 along a different radial location on tumbler 85 than the radial on which the color wipers 92–96 are located, here, with the black and color wipers being shown 180° apart for the purposes of illustration, advantageously allows different wiping schemes to be employed for cleaning the black printhead 70 and for cleaning the color printheads 72–76. For instance, the color pens 52–56 carrying dye-based inks may be wiped using a faster wiping speed than required for wiping the black pen 50 which dispenses a black pigment-based ink. In the past, many service stations used wipers that required both the black and color printheads to be wiped simultaneously, so compromises had to be made between the optimum wiping speeds for the black pigment-based ink and the color dye-based inks. Problems were encountered in the past because the slower wiping strokes required to clean the black printheads extracted excess ink from the color printheads. When using a faster wiping stroke for the color pens, without allowing excess time for the color ink to seep out between the orifice plate and the wipers, the black wiper would then skip over black ink residue on the black printhead. These problems are avoided by service station 80, which places the black wiper 90 and the color wipers 92–96 at different locations around the periphery of the tumbler 85, thus allowing wiping to be optimized for both the black printhead 70 and for the color printheads 72–76.

The advent of permanent or semi-permanent inkjet printheads for use in off-axis printers, such as printer 20, particularly those using different types of ink, such as a pigment-based black ink and dye-based color inks, has proved challenging for service station designers. New servicing approaches were required to clean and maintain the pens to extend the life of the printheads. In studying various servicing routines, it was felt that use of an ink solvent may be the optimum approach to printhead cleaning. In particular, it would be even more desirable if the ink solvent also served to lubricate the printhead orifice plates during wiping, which would then avoid unnecessary wear or damage to the printheads, thereby insuring a long printhead life. Furthermore, it would also be desirable for the ink solvent to act as a non-stick coating, which when applied to the printhead, functions to repel ink accumulation.

To accomplish these objectives, the service station 80 has an ink solvent applicator member or applicator 100, constructed in accordance with the present invention, along with a wiper cleaning member, scraper or blotter 102. The application 100 is housed in within a hollow receptacle or container 104. The applicator 100 is impregnated or soaked with an inkjet ink solvent 105. While the blotter 102 may be housed within the same container as the applicator 100, in the illustrated embodiment, the blotter 102 is housed within a blotter receptacle or container 106. Both the applicator container 104 and blotter container 106 are supported by the base of the station frame 82. While only the black printhead applicator and blotter are seen in the view of FIG. 2, the applicator 100 and blotter 102 may each be a unitary member extending in width across the service station frame 82 (parallel to the scanning axis 46, and in FIG. 2, into the plane of the drawing sheet) to also clean and apply solvent 105 to the color wipers 92–96, as well as the black wiper 90. Alternatively, it may prove beneficial to have four separate sets of applicators and blotters, one for each wiper 90, 92, 94 and 96. In another embodiment, it may be preferable to have two sets of applicators and blotters, with one set for the black pigment-based ink wiper 90, and the other set for all of the color dye-based ink wipers 92–96.

The inkjet ink solvent 105 is preferably a hygroscopic material that absorbs water out of the air, because water is a good solvent for the illustrated inks. Suitable hygroscopic solvent materials include polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have an almost zero vapor pressure. For the purposes of illustration, applicator 102 is soaked with the preferred ink solvent, PEG 105.

Preferably, the applicator 102 is made of a porous material, for instance, an open-cell thermoset plastic such as a polyurethane foam, a sintered polyethylene, or other functionally similar materials known to those skilled in the art. In a preferred embodiment the applicator 102 may be constructed of a high density polyethylene (HDPE) which is plasma-treated resulting in an affinity with the PEG solvent 105. In plasma treating, the entire applicator 102 is placed in a pressure-controlled cavity wherein the residing air is substantially evacuated, after which a gas is added to the cavity and a high frequency voltage is applied to the cavity. This high frequency voltage turns the gas into a plasma which then changes the surface chemistry of the solid by replacing some HDPE atoms with atoms from the gas. Through this plasma treatment process, the surface energy of the plastic can be drastically altered, and in the illustrated embodiment, this surface energy is raised, resulting in a smaller wetting angle, which in turn yields a larger capillary pressure. Typical gas additives are nitrous oxide, oxygen, or helium. Following this plasma treating process, the ink solvent 105 may be impregnated within the applicator 102 through immersion within liquid solvent 105. Alternatively, the applicator 102 may be force-filled with ink solvent 105 by drawing a vacuum through the applicator to eliminate air within the pores, followed by introduction of the ink solvent, which would eliminate the need for plasma treating.

FIG. 3 shows how the tumbler 85 is moved to place the various servicing components, such as the cap assembly 88 and the wipers 90–96 into positions for servicing the printheads 70–76. The outboard tumbler drive gear 86 is engaged by a set of transfer gears 108. A motor 110 has an output shaft upon which a pinion gear 112 is mounted to engage the transfer gear or gears 108 to rotate the tumbler 85, such as in the direction of arrow 83, so motor 110 may be referred to herein as the "rotation motor." The motor 110 operates in response to control signals received from the printer controller 40.

To raise and lower the tumbler 85 through translational movement, as indicated by arrow 114, the service station 80 has a second motor 115 with an output shaft which carries a pinion gear 116. The pinion gear 116 engages a set of transfer gears 118, which drive the inboard drive gear 86' of the tumbler 85. The motor 115 also operates in response to control signals received from the printer controller 40. The service station 80 has a pair of Z-cams on each end of tumbler 85, such as Z-cam 120 which has a bushing 122 that receives and rotatably supports both ends 84 and 84' of the tumbler axle. For convenience, only operation of the inboard Z-cam 120 is described. The Z-cam 120 moves back and forth along an interior surface of the service station frame 82, as indicated by arrow 124. The Z-cam 120 is captured between an upper guide member 126 and a lower guide member 128, which are preferably coated with or formed of a low friction material, such as of a Teflon filled plastic material. As the motor 115 drives the pinion gear 166, the set of transfer gears 118, and the inboard tumbler gear 86', this rotating motion is transformed into a revolving movement of the Z-cam 120 as the axle inboard end 84' then propels the Z-cam 120 for travel between the guides 126 and 128, as indicated by arrow 124. As the Z-cam 120 moves between the guides 126 and 128, the bushing 122 raises and lowers tumbler 85, as indicated by arrow 114.

Thus, the motor 115 is referred to herein as the "Z-motor." In FIG. 3, the dashed line representation of the Z-cam 120 is shown at the approximate location where the wipers are elevated into a wiping position for cleaning the printheads.

During the raising and lowering of the tumbler 85, it is desirable to maintain the engagement of gears 112, 108 and 86 so the tumbler may be rotated by the rotational motor 110, either during or after operation of the Z-motor 115. To accomplish this, a support bracket 130 is pivotally supported by an axle 132 which extends through an outboard sidewall 134 and an inboard sidewall 136 of the service station frame 82. Both the rotational motor 110 and the Z-motor 115 are supported by the pivoting bracket 132 for rotation in the direction indicated by arrow 138. The bracket 132 also maintains engagement of the gears 116, 118 and 86' to facilitate the raising and lowering of the tumbler 85. The outboard end 84 of the tumbler axle is rotatably supported by a bushing (not shown) supported by bracket 130.

Figure 4:
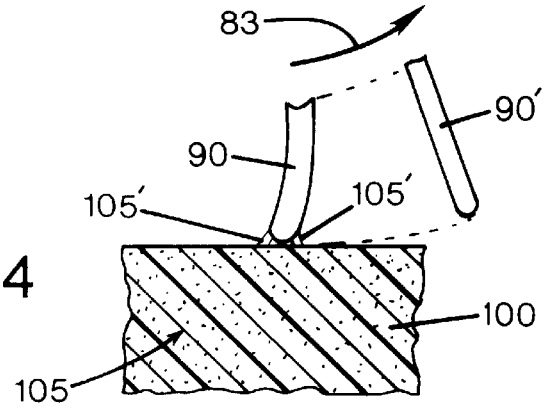

FIG. 4 shows an unsatisfactory method of picking the ink solvent 105 from the surface of the applicator 100. The tumbler 85 is first lowered to a pick elevation where a printhead wiper, such as the black wiper 90, may contact its associated applicator 100. At this pick elevation, the tumbler 85 is then rotated by motor 110 to slide the wiper across the surface of the applicator 100. During this sliding motion, a meniscus or wick of ink solvent 105' is formed to each side of the wiper as capillary forces draw or pull the ink solvent 105 from the pores of the applicator 100 and into the small spaces defined between the wiper 90 and the surface of applicator 100. This capillary action is also referred to as "wicking" by those skilled in the art. Unfortunately, if this sliding motion is continued through pure rotational movement of the tumbler 85, as shown by arrow 83 in FIG. 4, the meniscus of ink solvent 105' substantially reduces as the wiper snaps off the end of the wick, and very little solvent is retained by the wiper, as shown at wiper 90' in FIG. 4. Indeed, this sliding motion achieved through pure rotational movement of tumbler 85 is useful for removing excess fluid from the wiper 90, should such removal ever be desired.

Figure 5:
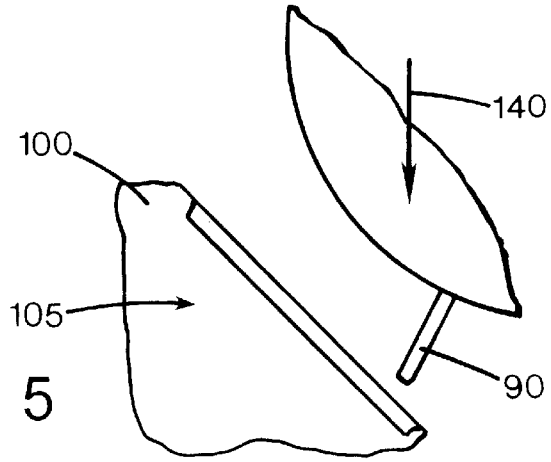
Figure 6:
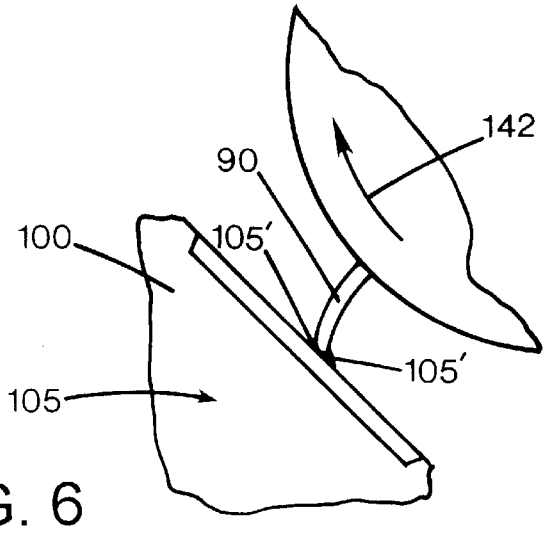
Figure 7:
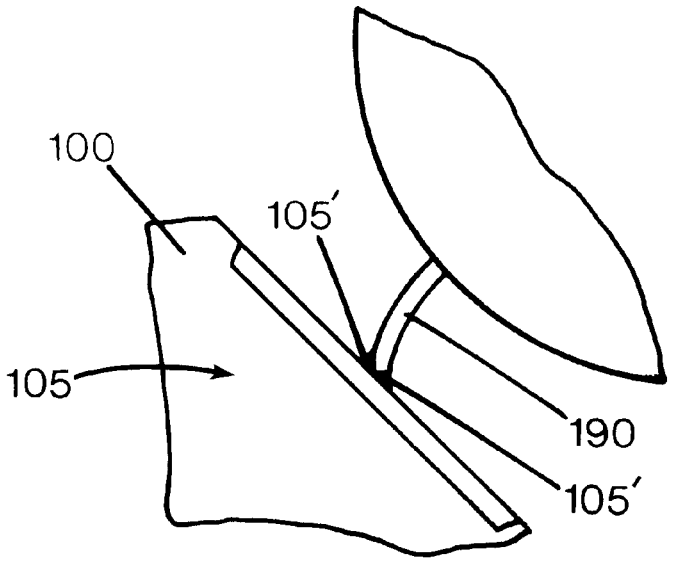
Figure 8:
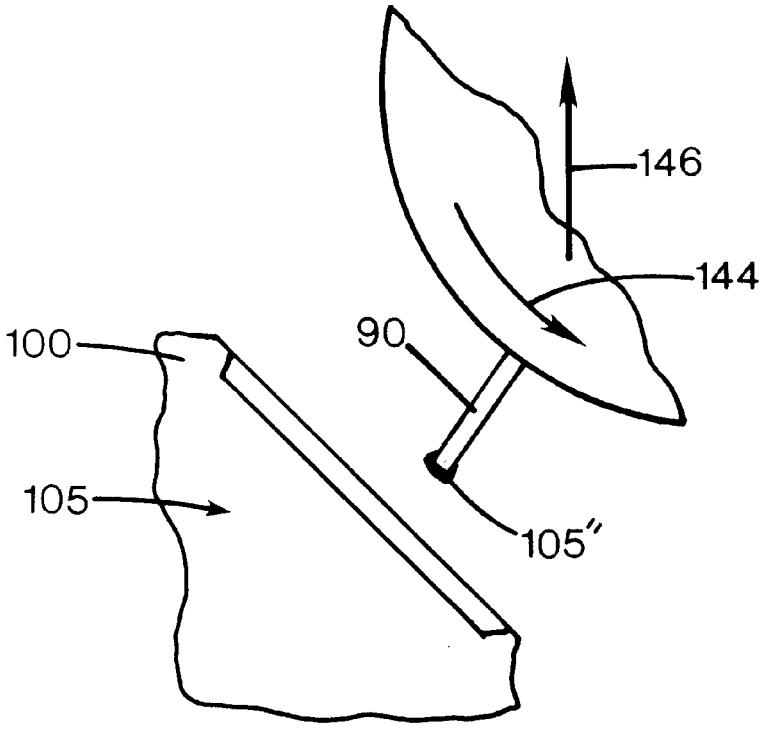

To avoid this pure sliding of the compliant wiper 90 along the noncompliant applicator 100, both the rotational motor 1 10 and the Z-motor 115 are operated simultaneously to provide the desired wiper motion. First the Z-motor 115 moves the wiper to a pre-pick elevation, as shown in FIG. 5 by arrow 140, prior to engaging the wiper 90 with the applicator 100. As shown in FIG. 6, the rotational motor 110 rotates the tumbler 85 in the direction of arrow 142 to move and drag the wiper 90 across the surface of the applicator 100, developing an adequate ink solvent meniscus 105'. Before rotating the wiper 90 to the point where the meniscus 105' is broken as described above with respect to FIG. 4, the system first pauses to let the meniscus reach equilibrium, with this pausing step being shown in FIG. 7. During this pause, the solvent is extracted through capillary forces from the applicator 100 and collected upon the wiper, as meniscus 105' is fully developed. A suitable pausing time, using the components and materials illustrated herein, is on the order of about one second, although other pause times may be used in different implementations or to pick different amounts of solvent. FIG. 8 shows the final picking operation, where the rotational motor 110 reverses direction, as indicated by arrow 144, while the Z-motor 115 lifts to move the wiper away from the applicator, as indicated by arrow 146. This combination of a reverse rotational (arrow 144) and a translational (arrow 146) disengagement of the wiper 90 from the solvent wick 105' retains an adequate amount of solvent on the wiper. FIG. 8 shows the wiper 90 now carrying a substantial amount of the ink solvent 105'''. Thus, this dual coordinated motion of concurrently reverse-rotating and lifting the wiper 90 serves to retain a sufficient amount of ink solvent 105'' on the tip of wiper 90.

HP Docket No. 10980094

Figure 9:
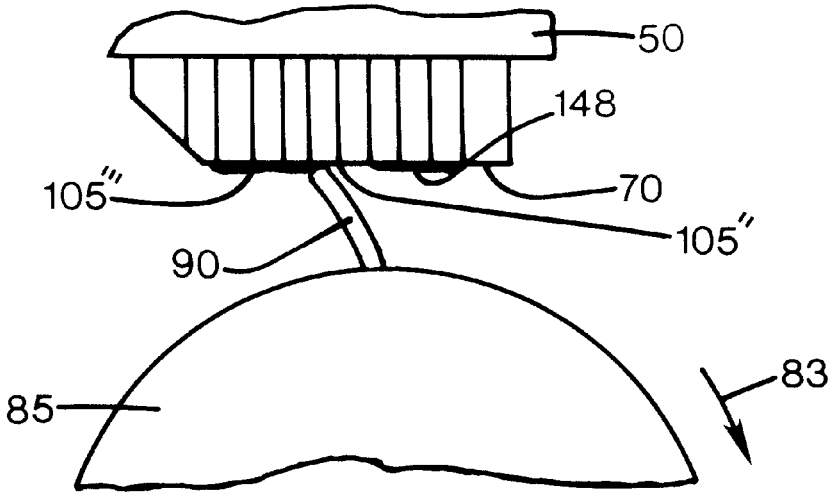
FIG. 9 is an enlarged, side elevational view of a wiper portion of the ink solvent application system of FIG. 1, shown wiping an inkjet printhead.

FIG. 9 illustrates the operation of cleaning ink residue from the printhead 70. Here we see the solvent 105''' that is being transferred from the tip of wiper 90 to the orifice plate of printhead 70, through rotational movement of tumbler 85 in the direction of arrow 83. In transitioning from the pick position of FIG. 8 to the wiping position of FIG. 9, the Z-motor 115 and Z-cam 120 have elevated the tumbler 85 to a servicing position to achieve the desired interference fit between wiper 90 and printhead 70, causing the wiper 90 to flex during the wiping stroke. The ink solvent 105'' along the leading edge of wiper 90 serves to dissolve dried ink residue 148 on printhead 70, while also serving as a lubricant between the wiper and printhead to prevent printhead wear. Additionally, along the trailing edge of the wiper 90, we see a thin film of solvent 105''', shown with an exaggerated thickness in FIG. 9 for the purpose of illustration, which remains on the printhead 70 as a protective coating.

Figure 10:
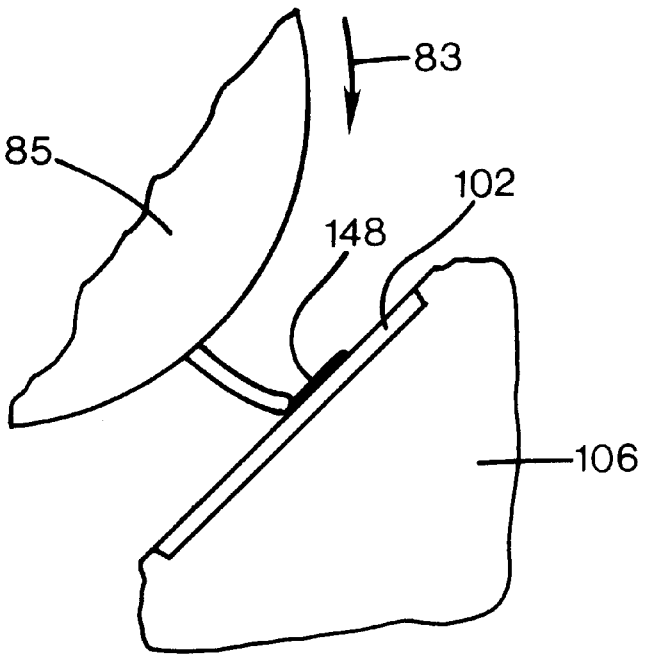
FIG. 10 is an enlarged, side elevational view of another portion of the ink solvent application system of FIG. 1, shown cleaning the wiper after wiping the inkjet printhead.

FIG. 10 shows the final step of the wiping sequence, where wiper 90 deposits the ink residue 148 on the blotter 102, as tumbler 85 rotates in the direction of arrow 83. In transitioning between the positions of FIGS. 9 and 10, the Z-motor 115 and Z-cam 120 operate to lower the tumbler 85 to a position where wiper 90 is in contact with the blotter 102 as shown in FIG. 10. From the wiper cleaning step of FIG. 10, the tumbler then rotates to the solvent picking step of FIG. 8, and the printhead cleaning sequence repeats as necessary to clean the printhead 90. While this wiping routine has been illustrated with respect to the black printhead 70 and the wiper 90, it is apparent that the color wipers 92–96 may be moved in a similar fashion by tumbler 85 to clean of the color printheads 72–76, respectively.

CONCLUSION

Thus, a variety of advantages are realized using the ink solvent applying service station 80. By storing the ink solvent in a porous medium, such as the applicator 100, the elastomeric wipers 90–96 are moved through coordinated operation of the rotational motor 110 and the Z-motor 115 in such a way that the elastomeric wiper extracts and retains a sufficient amount of ink solvent. The wipers are then moved to wipe the solvent 105 across the printheads 70–76 to dissolve accumulated ink residue. During this wiping stroke, the wipers also deposit a non-stick coating of solvent on the printhead orifice plate to advantageously retard further collection of ink residue. The wiper then moves across the blotter 102 to remove dissolved ink residue and dirtied solvent 105 from the wiper before beginning the next wiping stroke. The fluid ink solvent 105 also acts as a lubricant, so the rubbing action of the wiper advantageously does not unnecessarily wear the printhead. Thus, use of this ink solvent application system advantageously prolongs printhead life to provide consumers with a reliable, robust printer 20.

I claim:

1. A wiping system for cleaning a printhead in an inkjet printing mechanism, comprising:

a wiper;

a platform which supports the wiper for rotational movement and for translational movement between an application position and a wiping position for cleaning ink residue from the printhead;

a motor coupled to the platform to impart said rotational movement thereto; and an ink solvent-impregnated applicator located to contact with the wiper when the platform rotates in a first direction to the application position;

wherein the platform moves the wiper away from the applicator with a combination of both rotational movement in a second direction opposite said first direction and translational movement to retain the ink solvent on the wiper.

2. A wiping system according to claim 1 wherein:

the platform also supports the wiper for movement to a cleaning position for removing ink residue from the wiper; and the system further includes a wiper cleaner located to contact the wiper when in the cleaning position to remove ink residue therefrom.

3. A wiping system according to claim 2 wherein the wiper cleaner comprises an absorbent blotter member.

4. A wiping system according to claim 1 further comprising a second motor coupled to the platform to drive the platform for said translational movement.

5. A wiping system according to claim 4 wherein both the first motor and the second motor operate simultaneously to move the wiper away from the applicator.

6. A wiping system according to claim 1 wherein:

the wiper is of a compliant material; and the applicator is of a porous, non-compliant material having an application surface located for said contact with the wiper.

7. A wiping system according to claim 1 wherein said contact of the applicator with the wiper flexes the compliant material of the wiper, with a capillary region being defined between the flexed wiper and the application surface of the applicator to pull the ink solvent under capillary forces from the porous material of the applicator and into the capillary region.

8. A wiping system according to claim 1 wherein the platform pauses motion after rotation in said first direction and before beginning rotation in said second direction when rotation of the motor is stopped.

9. A method of cleaning ink residue from an inklet printhead in an inkjet printing mechanism, comprising the steps of:

applying an ink solvent to a wiper by:

(a) contacting the wiper with an applicator of a porous material impregnated with the ink solvent by dragging the wiper across the applicator rotationally in a first direction;

(b) extracting the ink solvent from the applicator through capillary forces and into a capillary region defined between the applicator and the wiper by pausing motion of the wiper; and (c) moving the wiper away from the applicator with a combination of both rotational movement and translational movement to retain the ink solvent on the wiper, wherein the rotational movement and the translational movement occur substantially simultaneously, with the rotational movement being in a direction opposite said first direction; and wiping the ink residue from the printhead and dissolving a portion of the ink residue in the ink solvent which was retained on the wiper.

10. An inkjet printing mechanism, comprising:

an inkjet printhead;

a wiper;

a platform which supports the wiper for rotational movement and for translational movement between an application position and a wiping position for cleaning ink residue from the printhead;

a motor coupled to the platform to impart said rotational movement to the platform; and an ink solvent applicator impregnated with an ink solvent, with the applicator being located for contact with the wiper through rotational movement of the platform in a first direction when the wiper is moved to the application position; and wherein the platform moves the wiper away from the applicator with a combination of both rotational movement a second direction opposite said first direction and translational movement to retain the ink solvent on the wiper.

11. An inkjet printing mechanism according to claim 10 wherein the platform also supports the wiper for movement to a cleaning position for removing ink residue from the wiper; and the system further includes a wiper cleaner located to contact the wiper when in the cleaning position to remove ink residue therefrom.

12. An inkjet printing mechanism according to claim 10 further comprising a second motor coupled to the platform to drive the platform for said translational movement.

13. An inkjet printing mechanism according to claim 10 wherein:

the wiper is of a compliant material; and the applicator is of a porous, non-compliant material having an application surface located for said contact with the wiper.

14. An inkjet printing mechanism according to claim 10 wherein said contact of the applicator with the wiper flexes the compliant material of the wiper, with a capillary region being defined between the flexed wiper and the application surface of the applicator to pull the ink solvent under capillary forces from the porous material of the applicator and into the capillary region.

15. An inkjet printing mechanism according to claim 10, wherein the platform pauses motion after rotation in said first direction and before beginning rotation in said second direction when rotation of the motor is stopped.

16. A method of cleaning ink residue from an inkjet printhead in an inkjet printing mechanism, comprising the steps of:

applying an ink solvent to a wiper by;

(a) dragging the wiper in a first direction across an applicator of a porous material impregnated with the ink solvent to extract the ink solvent from the applicator through capillary forces to form a meniscus of solvent between the wiper and the applicator, (b) pausing motion of the wiper after said dragging step to allow the meniscus to substantially reach equilibrium, and (c) removing the wiper from the applicator to retain the ink solvent on the wiper by simultaneously moving the wiper away from the applicator while also moving the wiper in a direction opposite said first direction; and wiping the ink residue from the printhead and dissolving a portion of the ink residue in the ink solvent which was retained on the wiper.

17. A method according to claim 16 wherein:

the dragging step comprises moving the wiper rotationally across the applicator in said first direction; and the removing step comprises the step of moving the wiper rotationally in said opposite direction.

* * * * *